US007104866B2

(12) United States Patent
Yamane et al.

(10) Patent No.: US 7,104,866 B2
(45) Date of Patent: Sep. 12, 2006

(54) MACHINING DEVICE

(75) Inventors: Yasuo Yamane, Hiroshima (JP); Masahiko Fukuta, Numazu (JP); Osamu Shirane, Mishima (JP)

(73) Assignee: Toshiba Kikai Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/179,641

(22) Filed: Jul. 13, 2005

(65) Prior Publication Data

US 2006/0019578 A1 Jan. 26, 2006

(30) Foreign Application Priority Data

Jul. 20, 2004 (JP) ..... 2004-212132

(51) Int. Cl.
*B24B 49/00* (2006.01)

(52) U.S. Cl. ..... 451/8; 408/5; 408/8; 408/12

(58) Field of Classification Search ..... 219/69.19; 451/5, 8, 9, 11; 340/686.6; 408/5, 6, 8, 408/10, 11, 12, 16; 384/100, 109, 114; 318/571
See application file for complete search history.

(56) References Cited

U.S. PATENT DOCUMENTS 4,405,421 A * 9/1983 Inoue ..... 205/645
4,608,476 A * 8/1986 Shimizu ..... 219/69.17
4,637,169 A * 1/1987 Sigg ..... 451/11
5,024,025 A * 6/1991 Kihara et al. ..... 451/11
6,140,931 A * 10/2000 Yamane et al. ..... 340/686.6

FOREIGN PATENT DOCUMENTS

| | | |
|---|---|---|
| JP | 10-217069 | 8/1998 |
| JP | 11-197997 | 7/1999 |
| JP | 2002-233933 | 8/2002 |

* cited by examiner

*Primary Examiner*—Jacob K. Ackun, Jr.
(74) *Attorney, Agent, or Firm*—Finnegan, Henderson, Farabow, Garrett, & Dunner, L.L.P.

(57) ABSTRACT

According to a machining device for machining a conductive workpiece (W) by a conductive (T), when the tool (T) contacts the workpiece (W) in machining, there is formed a closed-circuit (C) connecting the tool (T), the workpiece (W), a brush (315), a conductor (311), a main spindle housing (12), a main spindle (11) and again the tool (T in that order. Alternating-current is inducted to the closed-circuit (C) by a high-frequency generator (314) and an exciting coil (312). As a contact state between the tool (T) and the workpiece (W), impedance of the closed-circuit (C) is changed and then the alternating-current is changed, so that induction current is generated at a detector coil (313), thus monitoring and controlling the contact state by way of the induction current. Since a light contact state can constantly be maintained in machining according to a monitoring condition including a light/heavy contact-determining threshold, cutting resistance will not increase, thereby preventing damage on the tool (T) and deterioration in machining accuracy.

12 Claims, 10 Drawing Sheets

MACHINING DEVICE

BACKGROUND OF THE INVENTION

1. Field of the Invention

The present invention relates to a machining device. In particular, the present invention relates to a machining device capable of machining while monitoring and controlling a contact state between a workpiece and a tool.

2. Description of Related Art

Conventionally, there has been known a machining device described in Document: JP H10-217069A (on pages 4, 5, 8 and FIGS. 1, 2).

The machining device includes a machine body, a table attached to the machine body for setting a workpiece thereon, a main spindle for attaching a tool which machines the workpiece, a contact bearing interposed between the machine body and the main spindle for rotatably supporting the main spindle, a feeding electrode coaxially disposed to face the main spindle with a minute gap, and a conductor for electrically connecting the machine body with the feeding electrode. The machine body, the table, the main spindle and the feeding electrode are conductive, and also, the workpiece and the tool to be selected are conductive. Accordingly, when the workpiece and the tool come closer or contact with each other in machining, a closed-circuit is formed for connecting the workpiece, the tool, the main spindle, the feeding electrode, the conductor, the machine body, the table and again the workpiece in that order. Alternating-current is fed to the closed-circuit by an AC power supplier. The alternating-current is then detected by an electric-current detector including a resistor.

In machining, while the workpiece and the tool gradually come closer to contact with each other from their locations sufficiently spaced apart, impedance of the closed-circuit is changed along with the change in electrostatic capacitance CL of a capacitor defined by the workpiece and the tool, and then, detection current detected by the electric-current detector is changed. Owing to this, the approach and the contact of the workpiece and the tool can be sensed by way of the detection current.

With the machining device, the approach and the contact of the workpiece and the tool can be detected, however, once the workpiece contact the tool, the change in the contact state may no longer be detected. For example, when cutting is performed with a tool T contacting a workpiece surface W as shown in FIG. 10, as the tool T advances rightward in FIG. 10 and contacts a projecting portion P on the workpiece surface W, cutting load (mechanical load) between the workpiece surface W (projecting portion P) and the tool T rapidly increases. Even though there is generated the change in the above contact state, the rapid increase of the load cannot be corrected according to the above machining device described in the Document, and the cutting is forcedly performed with the excessive cutting load, thus resulting in disadvantages such as damage on the tool T and the deterioration in machining accuracy.

SUMMARY OF THE INVENTION

An object of the present invention is to provide a machining device capable of machining appropriately by monitoring and controlling a contact state between a workpiece and a tool as well as of preventing damage on the tool and deterioration in machining accuracy.

A machining device according to an aspect of the present invention includes: a workpiece holder that holds a conductive workpiece; a rotatable conductive tool holder that holds a conductive tool for machining the workpiece; a conductive first outer peripheral portion formed to cover at least a part of an outer peripheral surface of the tool holder; a first non-contact bearing formed by elevating the tool holder from an inner peripheral surface of the first outer peripheral portion; a conductor that electrically connects the first outer peripheral portion with the workpiece; a closed-circuit formed when the workpiece contacts the tool in machining, the closed-circuit connecting the workpiece, the tool, the tool holder, the first outer peripheral portion and the conductor in that order; an AC power supplier that feeds alternating-current to the closed-circuit; a detector that detects the alternating-current passing through the closed-circuit; and a monitoring/controlling unit that monitors an output value of a signal based on the alternating-current detected by the detector according to a predetermined monitoring condition, in which the monitoring condition includes a light/heavy contact-determining threshold for determining whether a contact state between the workpiece and the tool is a light contact or a heavy contact, and the monitoring/controlling unit controls the contact state between the workpiece and the tool so that the output value of the signal constantly stays within a light contact region relative to the light/heavy contact-determining threshold.

In the above aspect of the present invention, the workpiece is machined by contacting the rotating tool against the workpiece.

When the tool and the workpiece come into contact with each other in machining, the closed-circuit is formed for connecting the workpiece, the tool, the tool holder, the first outer peripheral portion, the conductor and again the workpiece in that order. Note that, there is the non-contact state between the tool holder and the first outer peripheral portion due to formation of the first non-contact bearing, however, the first non-contact bearing electrically defines the capacitor (hereinafter referred to as a first capacitor), thus allowing the alternating-current to be passed through.

The alternating-current is fed to the closed-circuit by an AC power supplier. As the contact state (machining state) between the tool and the workpiece is changed, impedance of the closed-circuit is changed since the contacting resistance (electric resistance) between the tool and the workpiece is changed, and the alternating-current passed through the closed-circuit is changed. Then, the detection current detected by the detector is changed, and consequently the change in the contact state is sensed.

The monitoring/controlling unit monitors the output value of the signal based on the detection current according to the monitoring condition. When the output value of the signal becomes the numeric value within a heavy contact region relative to the light/heavy contact-determining threshold (hereinafter, referred to as exceeding the light/heavy contact-determining threshold), it is determined that the monitoring condition is no longer satisfied, and then the monitoring/controlling unit adjusts the contact state between the workpiece and the tool to meet the monitoring condition. Therefore, since the contact state between the workpiece and the tool is maintained to be the light contact state, machining can be performed with the light cutting load (mechanical load), thereby preventing the damage on the tool and the deterioration in the manufacturing accuracy.

For example, in the case of FIG. 10, when the tool T cutting the workpiece surface W from the left side at a constant feed speed reaches the projecting portion P, the cutting resistance between the tool T and the workpiece surface W (projecting portion P) is rapidly increased to be the heavy contact state, thereby no longer meeting the monitoring condition. Then, the monitoring/controlling unit slows down the feed speed of the tool T or decreases the cutting depth of the tool T against the workpiece surface W so as to decrease the cutting resistance and recover the contact state to the light contact state. This can prevent the damage on the tool T due to the projecting portion P and the deterioration in the manufacturing accuracy.

Note that, the above-mentioned light contact state defines the contact state where the cutting load between the workpiece and the tool is light without possibility of damage on the tool and the deterioration in the manufacturing accuracy, and the heavy contact state defines the state where the cutting load is large with possibility of damage on the tool and the deterioration in the manufacturing accuracy. As figured out by the above definition, since the boundary of the light and heavy is not numerically determined strictly and is different according to the types of the workpiece and the tool, the light/heavy contact-determining threshold may be set appropriately with flexibility in some extent.

Incidentally, the first non-contact bearing of the present invention may be a gas bearing (particularly, hydrostatic bearing), a magnetic bearing, or an air/magnetic complex bearing. By forming the non-contact bearing, the friction resistance between the tool holder and the first outer peripheral portion can markedly be reduced, so that not only the tool holder and the tool can be rotated smoothly and precisely but also the manufacturing accuracy can be improved, thus providing the machining device appropriate for ultra-precision machining device.

A machining device according to another aspect of the present invention includes: a rotatable conductive workpiece holder that holds a conductive workpiece; a tool holder that holds a conductive tool for machining the workpiece; a conductive second outer peripheral portion formed to cover at least a part of an outer peripheral surface of the workpiece holder; a second non-contact bearing formed by elevating the workpiece holder from an inner peripheral surface of the second outer peripheral portion; a conductor that electrically connects the second outer peripheral portion with the tool; a closed-circuit formed when the workpiece contacts the tool in machining, the closed-circuit connecting the tool, the workpiece, the workpiece holder, the second outer peripheral portion and the conductor in that order; an AC power supplier that feeds alternating-current to the closed-circuit; a detector that detects the alternating-current passing through the closed-circuit; and a monitoring/controlling unit that monitors an output value of a signal based on the alternating-current detected by the detector according to a monitoring condition, in which the monitoring condition includes a light/heavy contact-determining threshold for determining whether a contact state between the workpiece and the tool is a light contact or a heavy contact, and the monitoring/controlling unit controls the contact state between the workpiece and the tool so that the output value of the signal constantly stays within a light contact region relative to the light/heavy contact-determining threshold.

In the above aspect of the present invention, the workpiece is machined by contacting the rotating workpiece against the tool.

When the tool and the workpiece come into contact with each other in machining, the closed-circuit is formed for connecting the tool, the workpiece, the workpiece holder, the second outer peripheral portion, the conductor and again the tool in that order. Note that, there is the non-contact state between the workpiece holder and the second outer peripheral portion due to formation of the second non-contact bearing, however, the second non-contact bearing electrically defines the capacitor (hereinafter referred to as a second capacitor), thus allowing the alternating-current to be passed through.

The alternating-current is applied to the closed-circuit by an AC power supplier. As the contact state (machining state) between the tool and the workpiece is changed, impedance of the closed-circuit is changed since the contacting resistance (electric resistance) between the tool and the workpiece is changed, and the alternating-current passed through the closed-circuit is changed. Then, the detection current detected by the detector is changed, and consequently the change in the contact state is sensed.

The monitoring/controlling unit monitors the output value of the signal based on the detection current according to the monitoring condition. When the output value of the signal exceeds the light/heavy contact-determining threshold, it is determined that the monitoring condition is no longer satisfied, and then the monitoring/controlling unit adjusts the contact state between the workpiece and the tool to meet the monitoring condition Therefore, since the contact state between the workpiece and the tool is maintained to be the light contact state, machining can be performed with the light cutting load (mechanical load), thereby preventing the damage on the tool and the deterioration in the manufacturing accuracy.

Incidentally, the second non-contact bearing of the present invention may be a gas bearing, a magnetic bearing, or an air/magnetic complex bearing. By forming the non-contact bearing, the friction resistance between the workpiece holder and the second outer peripheral portion can markedly be reduced, so that not only the workpiece holder and the workpiece can be rotated smoothly and precisely but also the manufacturing accuracy can be improved, thus providing the machining device appropriate for ultra-precision machining device.

Preferably, a machining device as another configuration may include: a rotatable conductive workpiece holder that holds a conductive workpiece; a rotatable conductive tool holder that holds a conductive tool for machining the workpiece; a conductive first outer peripheral portion formed to cover at least a part of an outer peripheral surface of the tool holder; a conductive second outer peripheral portion formed to cover at least a part of an outer peripheral surface of the workpiece holder; a first non-contact bearing formed by elevating the tool holder from an inner peripheral surface of the first outer peripheral portion; a second non-contact bearing formed by elevating the workpiece holder from an inner peripheral surface of the second outer peripheral portion; a conductor that electrically connects the first outer peripheral portion with the second outer peripheral portion; a closed-circuit formed when the workpiece contacts the tool in machining, the closed-circuit connecting the workpiece, the tool, the tool holder, the first outer peripheral portion, the conductor, the second outer peripheral portion and the workpiece holder in that order; an AC power supplier that feeds alternating-current to the closed-circuit; a detector that detects the alternating-current passing through the closed-circuit; and a monitoring/controlling unit that monitors an output value of a signal based on the alternating-current detected by the detector according to a predetermined monitoring condition, in which the monitoring condition includes a light/heavy contact-determining threshold for determining whether a contact state between the workpiece and the tool is a light contact or a heavy contact, and the monitoring/controlling unit controls the contact state between the workpiece and the tool so that the output value of the signal constantly stays within a light contact region relative to the light/heavy contact-determining threshold.

In the above configuration, the machining of the workpiece is performed by the tool since the tool and the workpiece come into contact with each other while at least one of them being rotated.

Here, the first non-contact bearing and the first capacitor are formed between the tool holder and the first outer peripheral portion while the second non-contact bearing and the second capacitor are formed between the workpiece holder and the second outer peripheral portion. The closed-circuit is formed with the first and second capacitors included. The alternating-current is applied to the closed-circuit, and the monitoring/controlling unit monitors and controls the contact state between the workpiece and the tool by way of the detection current detected by the detector. This maintains the contact state at the light contact state so as to machine with high accuracy but without the damage on the tool.

Preferably, in the above-described machining device, the monitoring/controlling unit may include an alerter unit that alerts a user when the, output value of the signal exceeds the light/heavy contact-determining threshold and becomes a value within a heavy contact region.

According to the above configuration, when the monitoring condition is not satisfied when the workpiece and the tool are in the heavy contact state, the reminder is given to the user, so that the user can immediately sense that the cutting load exceeds the allowable range. Owing to this, the user can promptly take action for reducing the cutting load, thus preventing the damage on the tool and the deterioration in machining accuracy.

Incidentally, the alert unit of the present invention can provide, any way such as activating an alarm (warning signal), lighting an alarm lamp, displaying a caution on a display, or outputting (printing out) a sheet with caution information being printed.

Preferably, in the above-described machining device, the monitoring/controlling unit may include: a storage unit that stores the monitoring condition; and an input unit that inputs a desired monitoring condition to be stored in the storage unit.

According to the above configuration, the machining can be conducted further appropriately based on the monitoring condition after inputting the optimum monitoring condition considering the purpose of the machining as well as the selection of the tool and the workpiece, and also the damage on the tool and the deterioration in the machining accuracy can be prevented.

Preferably, in the above-described machining device, the monitoring/controlling unit may include a display unit that displays information relating to the contact state between the workpiece and the tool.

According to the above configuration, the user can figure out the current contact state between the workpiece and the tool by looking at the information displayed on the display.

The information relating to the contact state may be the one directly displayed as a numeric value, a waveform, or an absolute value of the detection current detected by the detector. In another way, the detection current can be processed with calculation by an appropriate computing unit to be preferable for displaying the contact state. In still another way, when the detector is equipped with the detector circuit as described later, a numeric value, a waveform, or an absolute value of the induction current generated in the detector circuit can directly be displayed or the induction current can be processed with certain calculation. In yet another way, the contact state can be analyzed based on the detection current detected by the detector, and then the analyzed result can be displayed in characters. For example, a character representing "one" corresponding to the current contact state can be displayed from among the non-contact, light contact and the heavy contact. Note that, the above mentioned light/heavy contact-determining threshold can be utilized for determining whether the contact state is the light contact or the heavy contact.

Further, the display may not be the one having display screen, and may be a configuration having at least one of a first lamp (e.g. a blue lamp) lit in the light contact state, and a second lamp (e.g. a red lamp) lit in the heavy contact state. At this time, lightning of the lamp defines the information relating to the contact state.

Preferably, in the above-described machining device, the detector may include a detector circuit interlinked with a magnetic flux generated from the closed-circuit, and the monitoring/controlling unit monitors the output value of the signal based on induction current generated from the detector circuit according to the monitoring condition.

As the contact state between the workpiece and the tool is changed, the electric current passing through the closed-circuit is changed. Then, the magnetic flux generated by the closed-circuit and interlinked with the detector circuit is changed, so that the induction current is generated at the detector circuit. Accordingly, the contact state can be monitored by way of the induction current.

Preferably, in the machining device, the AC power supplier may include an AC power generator that generates alternating-current at a constant frequency, and an exciting circuit to which the alternating-current is fed, and the closed-circuit is interlinked with the magnetic flux generated from the exciting coil.

According to the above configuration, the magnetic flux periodically fluctuated at the constant frequency is generated from the exciting coil to which the alternating-current is applied. And, the alternating-current at the constant frequency upon the electromagnetic induction is inducted to the closed-circuit interlinked with the fluctuated magnetic flux. As the contact state between the workpiece and the tool is changed, the alternating-current is changed by the impedance of the closed-circuit changing, so that the contact state can be monitored by using the detection current detected by the detector.

DETAILED DESCRIPTION OF PREFERRED EMBODIMENT(S)

An embodiment of the present invention will be described below in reference to attached drawings.

First Embodiment

Figure 1:
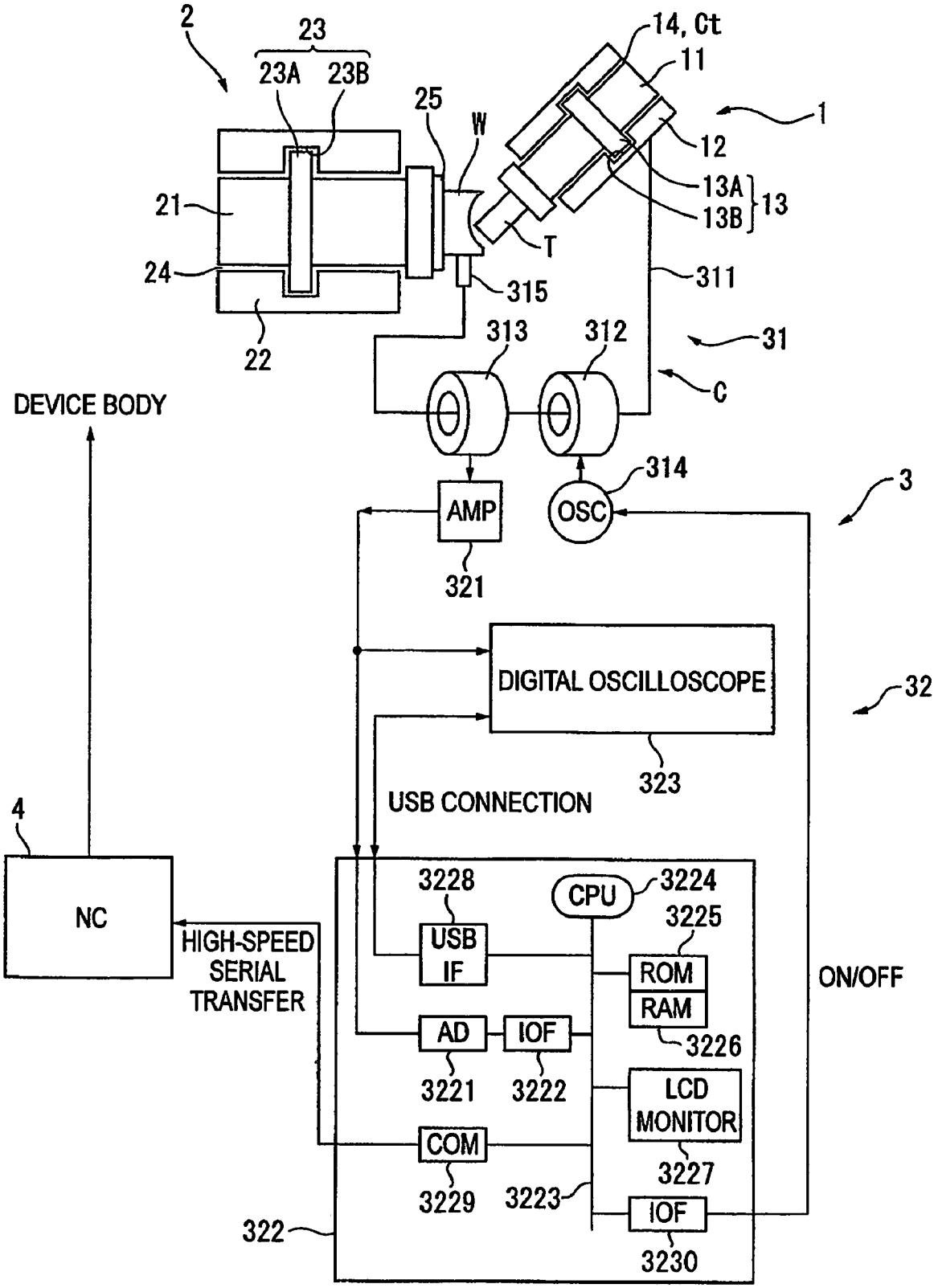
FIG. 1 is an illustration showing a machining device according to a first embodiment of the present invention.

FIG. 1 shows a machining device according to a first embodiment of the present invention.

The machining device performs cutting of a workpiece W with use of a tool T by rotating the tool T and the workpiece W. The tool T is made of conductive metal. The tool T may be an end mill formed with a nib and a cutting blade, or may be a grinding stone for finishing a machining surface. The tool T includes various kinds of tools different in their profiles, so that a user can select the optimum one considering the purpose of machining. In a case of the workpiece W, the one having conductivity, for example, the one made of steel is selected.

The tool T is detachably attached to a tool rotation driver 1 for rotating the tool T. The tool rotation driver 1 includes a main spindle 11 as a substantially columnar tool holder provided to rotate around an axis line (central axis), and a main spindle housing 12 as a first outer peripheral portion formed to cover an outer peripheral surface of the main spindle 11. The main spindle 11 and the main spindle housing 12 are made of metal, and have conductivity. Formed on the outer peripheral surface of the main spindle 11 is a flange 13A, and formed on the inner peripheral surface of the main spindle housing 12 is a groove 13B substantially with the same profile as the flange 13A, the flange 13A and the groove 13B defining a thrust bearing 13. Compressed-air is supplied to a space between the external peripheral surface of the main spindle 11 and the inner peripheral surface of the main spindle housing 12 by an unshown compressor or the like, the space defining a main spindle air bearing 14 as a first non-contact bearing. Accordingly, the main spindle 11 is elevated from the inner peripheral surface of the main spindle housing 12 to realize a non-contact state. As electrically considered, the main spindle 11 and the main spindle housing 12 are in insulation state with each other, in other words, there is formed a capacitor. The capacitor is hereinafter referred to as a capacitor Ct.

The tool T is detachably attached to a tip end of the main spindle 11, so that the main spindle 11 and the tool T are integrally rotated around the axis line (central axis) with use of a rotation driver such as an unshown electric motor (motor), an air turbine or the like. The number of rotation in ultra-precision machining will be 30,000 rpm or more. At this time, the main spindle air bearing 14 markedly reduces the friction resistance generated between the main spindle 11 and the main spindle housing 12, so that the main spindle 11 and the tool T can smoothly rotate. In addition, since the thrust bearing 13 bears the load of the main spindle 11 in an axial direction, the main spindle 11 would not shift in the axial direction. Further, the amount and the pressure of the compressed-air supplied from the compressor for defining the main spindle air bearing 14 are manually set by a regulator (not shown), so that the elevated state of the main spindle 11 from the inner peripheral surface of the main spindle housing 12 is strictly determined, thereby precisely positioning (i.e., centering) the axis line of the main spindle 11. Therefore, the machining accuracy can markedly be improved with use of the tool T according to the present embodiment, thus providing the machining device appropriate for ultra-precision machining. Note that, the amount and the pressure of the compressed-air can numerically controlled by a NC device 4 described below.

The workpiece W is detachably attached to a workpiece rotation driver 2 for rotating the workpiece W. The workpiece rotation driver 2 includes a workpiece shaft 21 as a substantially columnar workpiece holder provided to rotate around an axis line (central axis), and a workpiece shaft housing 22 as a second outer peripheral portion formed to cover an outer peripheral surface of the workpiece shaft 21. The axial direction of the workpiece shaft 21 is formed to be inclined by a predetermined angle relative to the axial direction of the main spindle 11, the angle being adjustable by the user considering the purpose of machining.

Note that, while the main spindle 11 and the workpiece shaft 21 are shown in a single plane in FIG. 1 because of simplification, the user can desirably adjust the actual relative positions of the main spindle 11 and the workpiece shaft 21.

Formed on the outer peripheral surface of the workpiece shaft 21 is a flange 23A, and formed on the inner peripheral surface of the workpiece shaft housing 22 is a groove 23B substantially with the same profile as the flange 23A, the flange 23A and the groove 23B defining a thrust bearing 23. Compressed-air is supplied to a space between the external peripheral surface of the workpiece shaft 21 and the inner peripheral surface of the workpiece shaft housing 22 by an unshown compressor or the like, the space defining a workpiece shaft air bearing 24 as a second non-contact bearing. Accordingly, the workpiece shaft 21 is elevated from the inner peripheral surface of the workpiece shaft housing 22 to realize a non-contact state.

The workpiece W is coaxially set on a tip end of the workpiece shaft 21 via an insulation 25. The workpiece shaft 21 and the workpiece W are integrally rotated around the axis line (central axis) with use of a rotation driver such as an unshown electric motor (motor), an air turbine or the like. At this time, the workpiece shaft air bearing 24 markedly reduces the friction resistance generated between the workpiece shaft 21 and the workpiece shaft housing 22, so that the workpiece shaft 21 and the workpiece W can smoothly rotate. In addition, since the thrust bearing 23 bears the load of the workpiece shaft 21 in an axial direction, the workpiece shaft 21 would not shift in the axial direction. Further, the amount and the pressure of the compressed-air supplied from the compressor for defining the workpiece shaft air bearing 24 are manually set by a regulator (not shown), so that the elevated state of the workpiece shaft 21 from the inner peripheral surface of the workpiece shaft housing 22 is strictly determined, thereby precisely positioning (i.e., centering) the axis line of the workpiece shaft 21. Therefore, the machining accuracy of the workpiece W can markedly be improved with use of the tool T according to the present embodiment, thus providing the machining device appropriate for ultra-precision machining. Note that, the amount and the pressure of the compressed-air can numerically controlled by the NC device 4 described below.

The tool rotation driver 1 and the workpiece rotation driver 2 are attached to a device body (not shown) of the machining device. At least one of the tool rotation driver 1 and the workpiece rotation driver 2 is moved by a driver (not shown) provided on the device body, so that the one can relatively move against the other. Accordingly, the tool T can machine the workpiece W with relatively moved against the workpiece W. At this time, the feed speed and the cutting depth of the tool T and the workpiece W are numerically controlled by the NC device 4 described later, thus appropriately machining.

The machining device of the present embodiment includes a contact state detecting/monitoring/controlling system 3 that detects the contact state (machining state) between the tool T and the workpiece W, and then monitors and controls the contact state based on the detected result. The contact state detecting/monitoring/controlling system 3 has an information acquirer 31 that acquires information relating to the contact state by utilizing induction current upon electromagnetic induction, and a monitoring/controlling system 32 that monitors and controls the contact state according to the acquired information.

The information acquirer 31 has a conductor 311 attached to the main spindle housing 12 at an end while attached to the workpiece W at the other end, an exciting coil 312 and a detector coil 313 provided around the conductor 311, and a high-frequency generator (OSC) 314 as an AC power generator that feeds alternating-current with constant frequency to the exciting coil 312. The other end of the conductor 311 is slidably attached to the workpiece W via a conductive brush 315. Owing to this, the other end of the conductor 311 is electrically connected to the workpiece W continuously even when the workpiece W is rotated in machining. Incidentally, the exciting coil 312 defines an exciting circuit of the present invention while the detector coil 313 defines a detector circuit of the present invention. The frequency of the alternating-current generated by the high-frequency generator 314 can be set in accordance with the purpose of machining, the selection of the tool T and the workpiece W, or the like.

When the tool T contacts the workpiece W in machining, a closed-circuit is formed in a counterclockwise direction in FIG. 1, the closed-circuit connecting the tool T, the workpiece W, the brush 315, the conductor 311, the main spindle housing 12, the main spindle 11 and again the tool T in that order. Incidentally, there is capacitive coupling between the main spindle housing 12 and the main spindle 11, the capacitive coupling defining a capacitor of the electrostatic capacity Ct as mentioned before. Hereinafter, the closed-circuit is referred to as a closed-circuit C.

As high frequency wave with the constant frequency is applied to the exciting coil 312 by the high-frequency generator 314, there is generated from the exciting coil 312 magnetic flux with the same frequency upon the electromagnetic induction. The magnetic flux interlinks the closed-circuit C, so that alternating-current with the same frequency is inducted to the closed-circuit C upon the electromagnetic induction, and consequently, the magnetic flux is generated from the closed-circuit C. Since the magnetic flux interlinks the detected coil 313, induction current is generated in the detector coil 313. Incidentally, the high-frequency generator 314 and the exciting coil 312 define an AC power supplier of the present invention because they apply alternating-current to the closed-circuit C.

As the contact state (machining state) between the tool T and the workpiece W is changed, the contacting resistance between the tool T and the workpiece W is, changed, accordingly impedance of the closed-circuit C being changed. Then, the alternating-current applied to the closed-circuit C is changed, causing the induction current in the detector coil 313 to be changed, and therefore, the change in the contact state is sensed.

Incidentally, the detector coil 313 defines a detector of the present invention, the detector detecting the alternating-current passing through the closed-circuit C.

The monitoring/controlling system 32 includes an amplifier unit (AMP) 321 that amplifies a signal (a signal based on the induction current) from the detector coil 313, a controller (a control device) 322 that monitors and controls the contact state based on the amplified signal, and a digital oscilloscope 323 that displays the amplified signal in real time.

Though not shown, the amplifier unit 321 has an amplifier, a cymoscope, a thermoelectric conversion module and the like.

In the controller 322, the amplified signal (analog signal) from the amplifier unit 321 is converted into a digital signal with use of an A/D converter (AD) 3221, the digital signal being input to a bus 3223 via an I/O interface (IOF) 3222. In the bus 3223, the digital signal is transmitted under the arithmetic control of a CPU 3224. The CPU 3224 arithmetically controls the digital signal based on a control program stored in a ROM 3225 as well as various data and flags stored in a RAM 3226.

The RAM 3226, a storage unit of the present invention, stores a monitoring condition regulating an allowable output range of the digital signal (unit: mV). The monitoring condition includes a light/heavy contact-determining threshold S1 regulating the upper limit of the allowable output range and a non/heavy contact-determining threshold S2 regulating the lower limit. Note that, the threshold S1 is the one for judging whether the contact state between the tool T and the workpiece W is light contact or heavy contact, while the threshold S2 is the one for judging whether the contact state therebetween is non-contact or light contact. In other words, the contact state between the tool T and the workpiece W is judged as: heavy contact state when an output value S of the digital signal indicating that (i) S is greater than S1; light contact state when indicating that (ii) S is equal to or less than S1 as well as equal to or greater than S2; or non-contact state when indicating that (iii) S is less than S2. Only the light contact state (ii), where the output value of the digital signal is within the allowable output range, meets the monitoring condition. But, neither the heavy contact state (i) nor the non-contact state (iii) do not meet the monitoring condition.

The thresholds S1 and S2 can be stored in the RAM 3226 by inputting the value appropriately set by the user according to the selection of the tool T and the workpiece W, or the purpose of machining with use of an input unit (not shown).

Here, the contact state between the tool T and the workpiece W will be described referring to FIGS. 2A to 2D. The tool T in these drawings is the one having a plurality of minute metal particles G on the surface for cutting the workpiece W using these metal particles G. Each arrow in the drawings shows the rotation of the tool T.

Figure 2A:
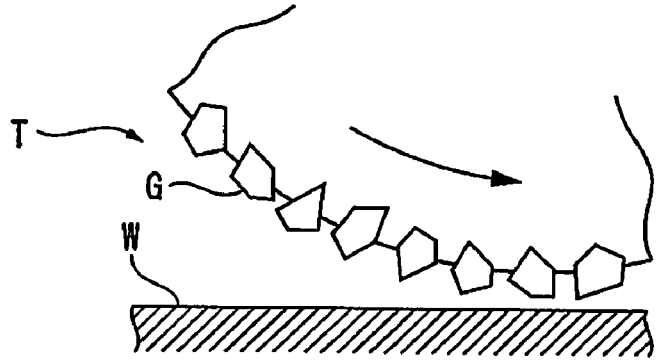
FIGS. 2A to 2D are explanatory diagrams each showing a contact state between a tool and a workpiece according to the aforesaid embodiment.

FIG. 2A shows the non-contact state (which does not meet the monitoring condition). It shows the situation where cutting is not performed since the tool T does not contact the workpiece W. At this time, the tool T idles. In order to perform cutting promptly for enhancing machining efficiency in cutting, the time in the non-contact state must be shorten as far as possible.

Figure 2B:
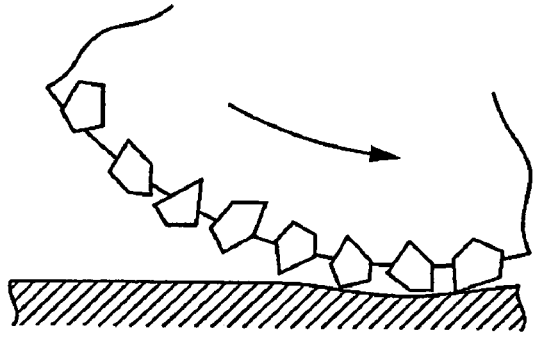

FIG. 2B shows the light contact state (which meets the monitoring condition). In this situation, cutting is performed while the tool T and the workpiece W contact to each other with a light cutting load. The smooth cutting can be conducted without an excessive load applied to the tool T and the workpiece W, thereby the tool T being hardly damaged and realizing high cutting accuracy. Therefore, the cutting provides the best performance in the light contact state.

Figure 2C:
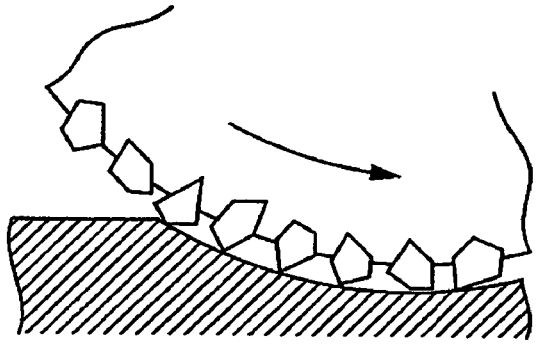
Figure 2D:
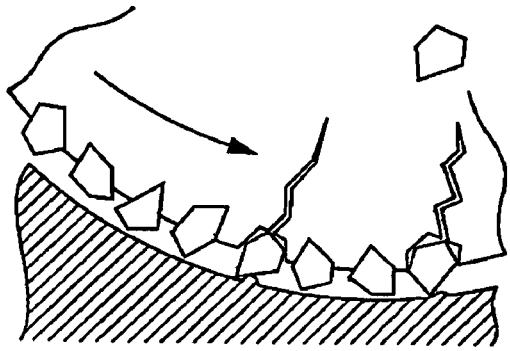

FIGS. 2C and 2D each show the heavy contact state (which does not meet the monitoring condition). In this situation, a large cutting load is applied to the tool T and the workpiece W. In FIG. 2C, the tool T is not damaged yet, however, the tool T is forcedly pressed against the workpiece W, likely causing deterioration in the machining accuracy. In FIG. 2D, the tool T is further forcedly pressed against the workpiece W, which results in damaging the tool T.

Now, go back to FIG. 1 and provide explanation. On an LCD monitor 3227 having a liquid crystal display, there are displayed the thresholds S1 and S2 for the monitoring condition next to the output value of the actual digital signal. The user can immediately judge whether or not the monitoring condition is satisfied, and can promptly take action for meeting the monitoring condition by adjusting the contact state between the tool T and the workpiece W into the light contact state if the monitoring condition is not satisfied, thus constantly maintaining the tool T and the workpiece W in the light contact state. Hence, the damage on the tool T as well as the deterioration in the machining accuracy can be prevented by avoiding the heavy contact state, and idle cutting time can be prevented by avoiding the non-contact state, thus machining promptly and precisely.

Incidentally, the LCD monitor 3227 defines a display unit of the present invention, which displays information relating to the contact state between the tool T and the workpiece W. Here, the information relating to the contact state indicates the output value of the digital signal.

Otherwise, various parameters such as: the feed speed, the cutting depth, the number of rotation of the tool T; the feed speed and the number of rotation of the workpiece W; the amount and the pressure of the compressed-air supplied between the main spindle 11 and the main spindle housing 12 by the compressor; the amount and the pressure of the compressed-air supplied between the workpiece shaft 21 and the workpiece shaft housing 22 by the compressor; the distance between the main spindle 11 and the main spindle housing 12; (the value of) the electrostatic capacity of the capacitor Ct; the distance between the workpiece shaft 21 and the workpiece shaft housing 22; and the like can be detected by certain detectors and then displayed on the LCD monitor 3227 as auxiliary information for monitoring the contact state. If thresholds regulating the allowable ranges of these parameters are additionally displayed on the LCD monitor 3227, the user can precisely and promptly judges whether or not the numeric values of these parameters are appropriate to promptly take action for recovering the contact state to the light contact from the heavy contact or the non-contact. These thresholds regulating these allowable ranges are input and stored in the RAM 3226 by an unshown input unit, which is utilized as an auxiliary condition for monitoring the contact state.

The digital oscilloscope 323 not only acquires the amplified signal from the amplifier unit 321 and then displays it in waveform, but also receives an alarm signal from the controller 322 as a USB (Universal Serial Bus) signal and then displays it as alarm information.

Note that, the alarm signal is an alert signal transmitted to the digital oscilloscope 323 via the USB interface (USB IF) 3228 at the time when at least one of the monitoring condition (the condition relating to the output value of the digital signal from the AD converter 3221) stored in the RAM 3226 and the auxiliary condition is no longer satisfied.

Provided on the display screen of the digital oscilloscope 323 are a plurality of alarm lamps for displaying the alarm information corresponding to the monitoring condition and the auxiliary condition, only the alarm lamp which corresponds to the unsatisfied condition will be lit. Accordingly, the abnormal contact state (heavy contact or non-contact) is notified to the user to remind him/her. The user can immediately find out which condition is not satisfied by looking at the lit alarm lamp, so that the user can promptly and precisely take action for recovering the contact state to normal (light contact).

As described above, the digital oscilloscope 323 defines an alert unit of the present invention.

The alarm signal from the controller 322 is sent to the NC device 4 by high-speed serial transfer via a high-speed bus interface (COM) 3229. The NC device 4 automatically corrects the various numeric value data for machining control according to the received alarm signal, and promptly shifts the machining status to the one meeting the all conditions (the monitoring condition and the auxiliary condition) stored in the RAM 3226, namely, to the light contact state.

Note that, as for the various numeric data for machining control, various parameters may be exemplified such as: the feed speed, the cutting depth, the number of rotation of the tool T; the feed speed and the number of rotation of the workpiece W; the amount and the pressure of the compressed-air supplied between the main spindle 11 and the main spindle housing 12 by the compressor; the amount and the pressure of the compressed-air supplied between the workpiece shaft 21 and the workpiece shaft housing 22 by the compressor; the distance between the main spindle 11 and the main spindle housing 12; (the value of) the electrostatic capacity of the capacitor Ct; and the distance between the workpiece shaft 21 and the workpiece shaft housing 22.

As described above, even when one of the various conditions stored in the RAM 3226 is no longer satisfied because the contact state between the tool T and the workpiece W becomes abnormal (heavy contact or non-contact), the NC device 4 promptly corrects this situation to meet the all conditions, so that the contact state can be recovered to normal (light contact). Hence, the damage on the tool T as well as the deterioration in the machining accuracy can be prevented by avoiding the heavy contact state, and idle cutting time can be prevented by avoiding the non-contact state, thus machining promptly and precisely.

According to the above configuration, the monitoring/controlling system 32 and the NC device 4 define a monitoring/controlling unit of the present invention, which monitors the output value of the signal based on the induction current generated in the detector coil 313 as the detector and controls the contact state between the tool T and the Work W.

In FIG. 1, the I/O interface (IOF) 3230 is provided for turning ON/OFF the power of the high-frequency generator 314. As an unshown ON/OFF switch provided in the controller 322 is turned ON/OFF, an ON/OFF signal is transmitted to the high-frequency generator 314 via the I/O interface 3230, so that the power of the high-frequency generator 314 is turned ON/OFF. When the power of the high-frequency generator 314 is turned ON, the high frequency wave is generated to monitor and control the contact state (machining state), and when the power is turned OFF, the high frequency wave is not generated and monitoring and controlling are not conducted.

Second Embodiment

Next, a second embodiment of the present invention will be described. The same numeric numbers are applied to components identical with or corresponding to that described in the first embodiment for omitting or simplifying the description (in a third, fourth, fifth or sixth embodiment as well).

Figure 3:
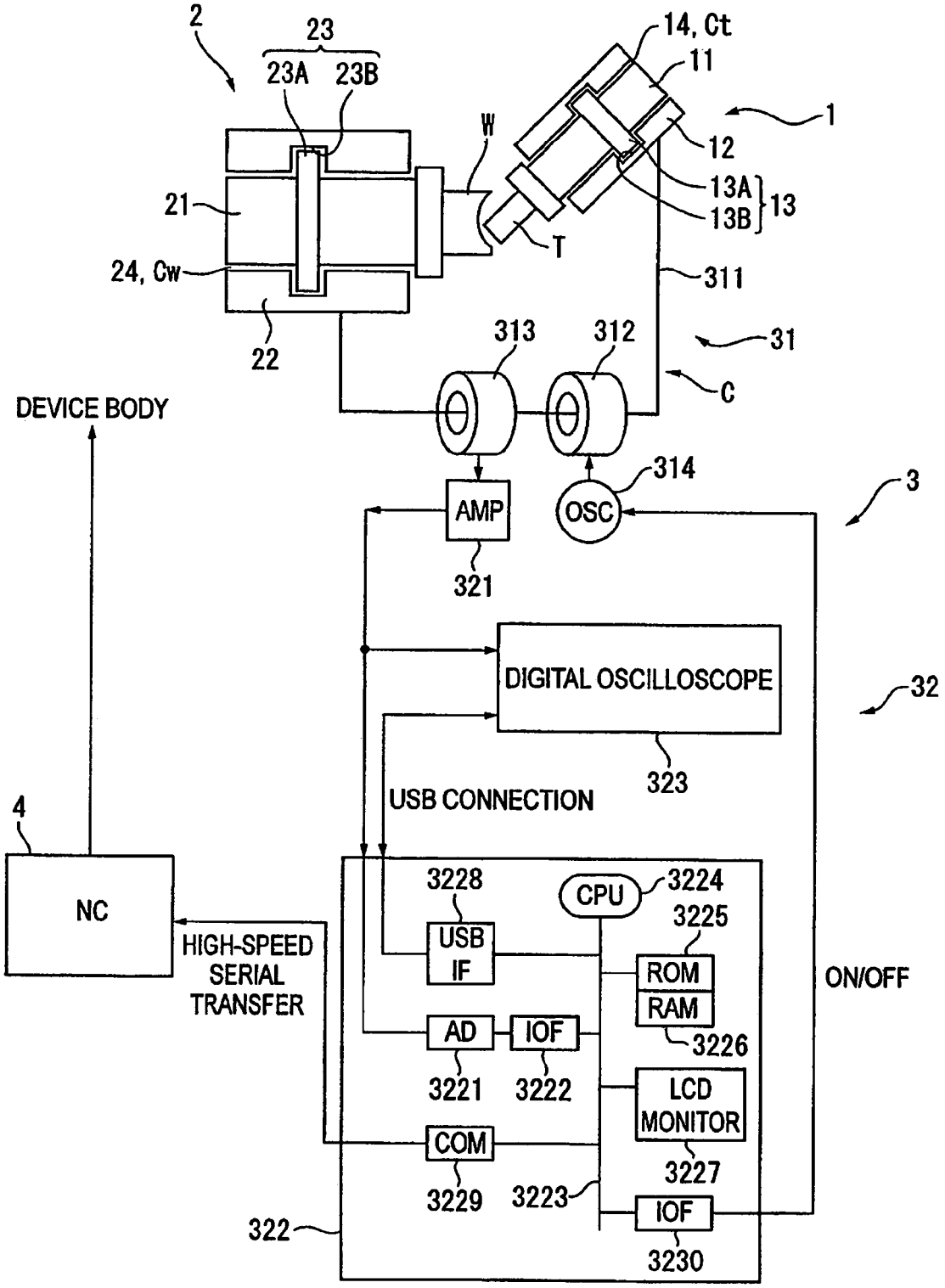
FIG. 3 is an illustration showing a machining device according to a second embodiment of the present invention.

As shown in FIG. 3, in a machining device according to a second embodiment of the present invention, the insulation 25 interposed between the workpiece W and the workpiece shaft 21 in the first embodiment is removed, so that the workpiece W is electrically connected to the workpiece shaft 21 directly. The other end of the conductor 311 is directly attached to the workpiece shaft housing 22. Assume that the workpiece shaft 21 and the workpiece shaft housing 22 are conductive.

According to the above configuration, when the tool T contacts the workpiece W in machining, a closed-circuit C is formed in a counterclockwise direction in FIG. 3, the closed-circuit connecting the tool T the workpiece W, the workpiece shaft 21, the workpiece shaft housing 22, the conductor 311, the main spindle housing 12, the main spindle 11 and again the tool T in that order. Incidentally, there is capacitive coupling between the workpiece shaft 21 and the workpiece shaft housing 22, the capacitive coupling defining a capacitor Cw.

It is the same as first embodiment that the change in the alternating-current passing through the closed-circuit C generated along with the change in the contact state (machining state) between the tool T and the workpiece W is detected by the detector coil 313 as the induction current to monitor and control the contact state.

The numeric value of the electrostatic capacity of the capacitor Cw may be displayed on the LCD monitor 3227 as an auxiliary information for monitoring the contact state, or alternatively be employed as the numeric value data for numeric control in the NC device 4. Or, the auxiliary condition for regulating an appropriate numeric value range of the electrostatic capacity Cw may be set and then stored in the RAM 3226, so that alarm information is displayed on a screen display of the digital oscilloscope 323 when the auxiliary condition is not satisfied.

Third Embodiment

Next, a third embodiment of the present invention will be described.

Figure 4:
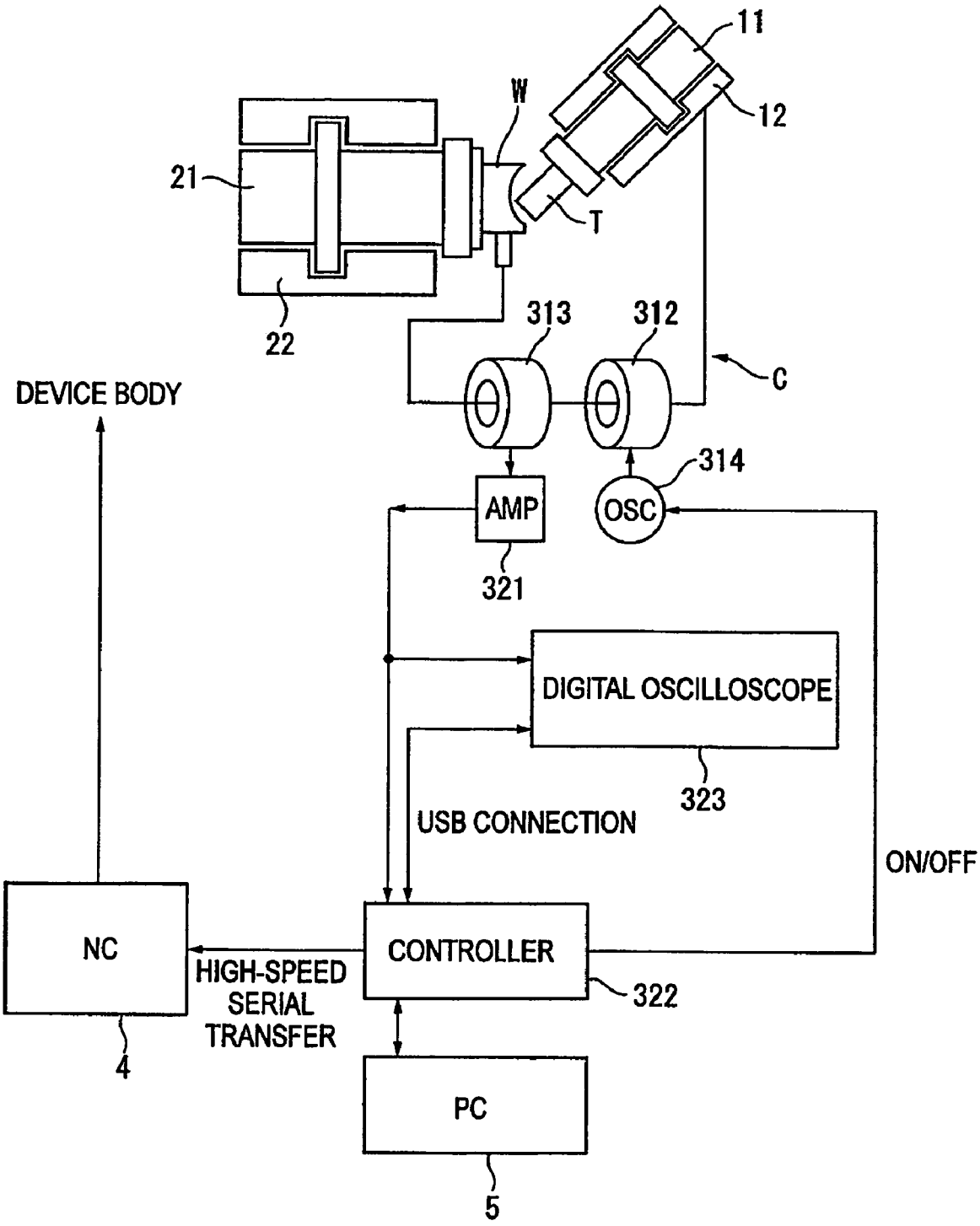
FIG. 4 is an illustration showing a machining device according to a third embodiment of the present invention.

As shown in FIG. 4, in a machining device according to the present embodiment, a personal computer (PC) 5 is provided instead of the LCD monitor 3227 of the first embodiment. The personal computer 5 exchanges data with the controller 322 by a signal of USB. Similar to the first embodiment, on a display screen (a display) of the personal computer 5, there are displayed thresholds S1 and S2 regulating an allowable output range of the digital signal from the AD converter 3221 next to the output value of the actual digital signal. Further, the various pieces of auxiliary information and the various auxiliary conditions for monitoring the contact state can also be displayed.

Fourth Embodiment

Next, a fourth embodiment of the present invention will be described.

Figure 5:
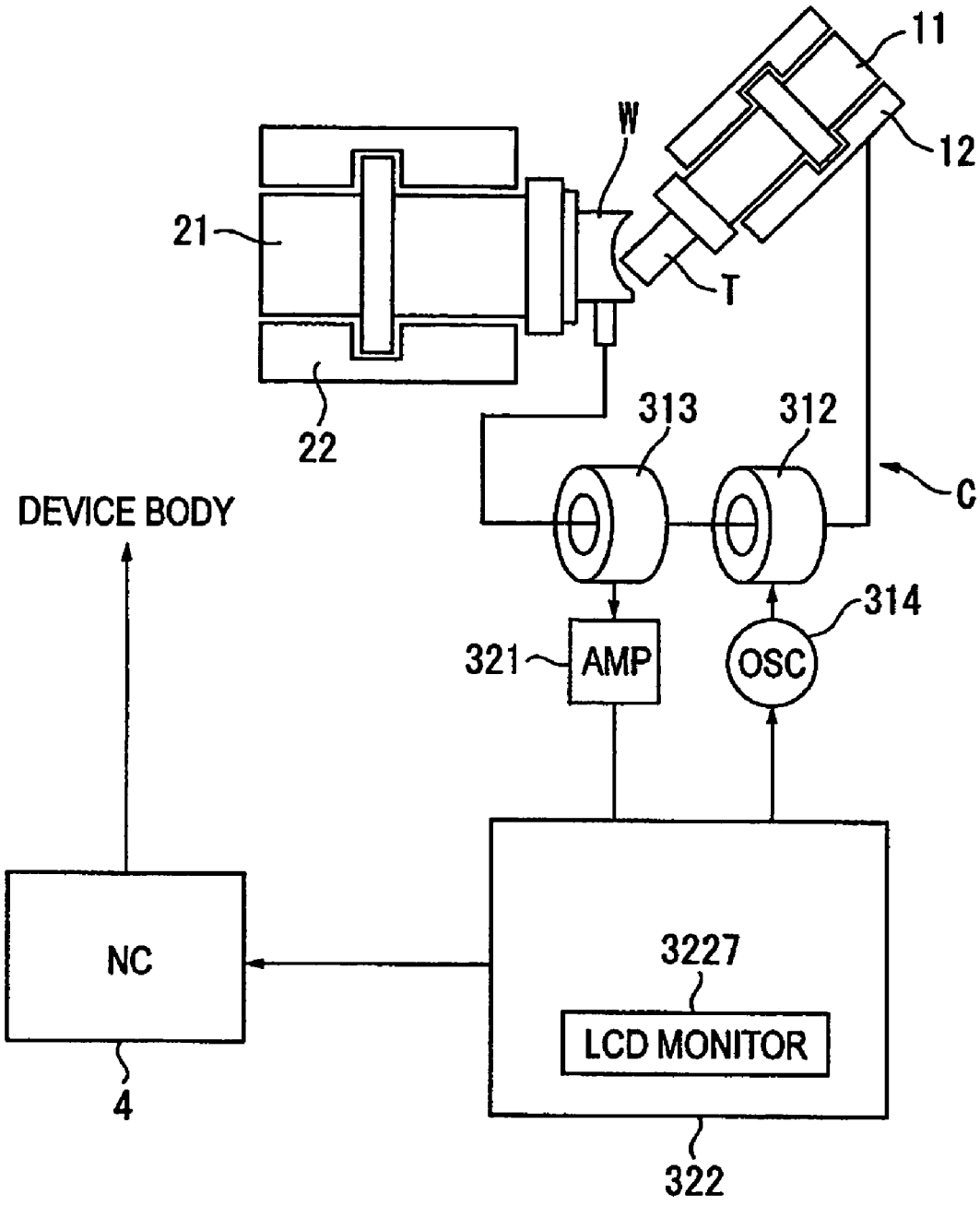
FIG. 5 is an illustration showing a machining device according to a fourth embodiment of the present invention.

As shown in FIG. 5, in a machining device according to the present embodiment, there is not provided the digital oscilloscope 323 of the first embodiment, and alternatively, the amplified signal from the amplifier unit 321 is displayed in waveform on the LCD monitor 3227, the amplified signal being processed with analog-to-digital conversion (being converted into digital from analog) by the A/D converter 3221. In addition, the various pieces of numeric value information and conditions may be displayed on the LCD monitor 3227 together with the waveform display. Further, a storage display may be employed as the monitor 3227 to draw the above-described waveform, numeric value information and conditions on the screen with electron beam.

Fifth Embodiment

Next, a fifth embodiment of the present invention will be described.

Figure 6:
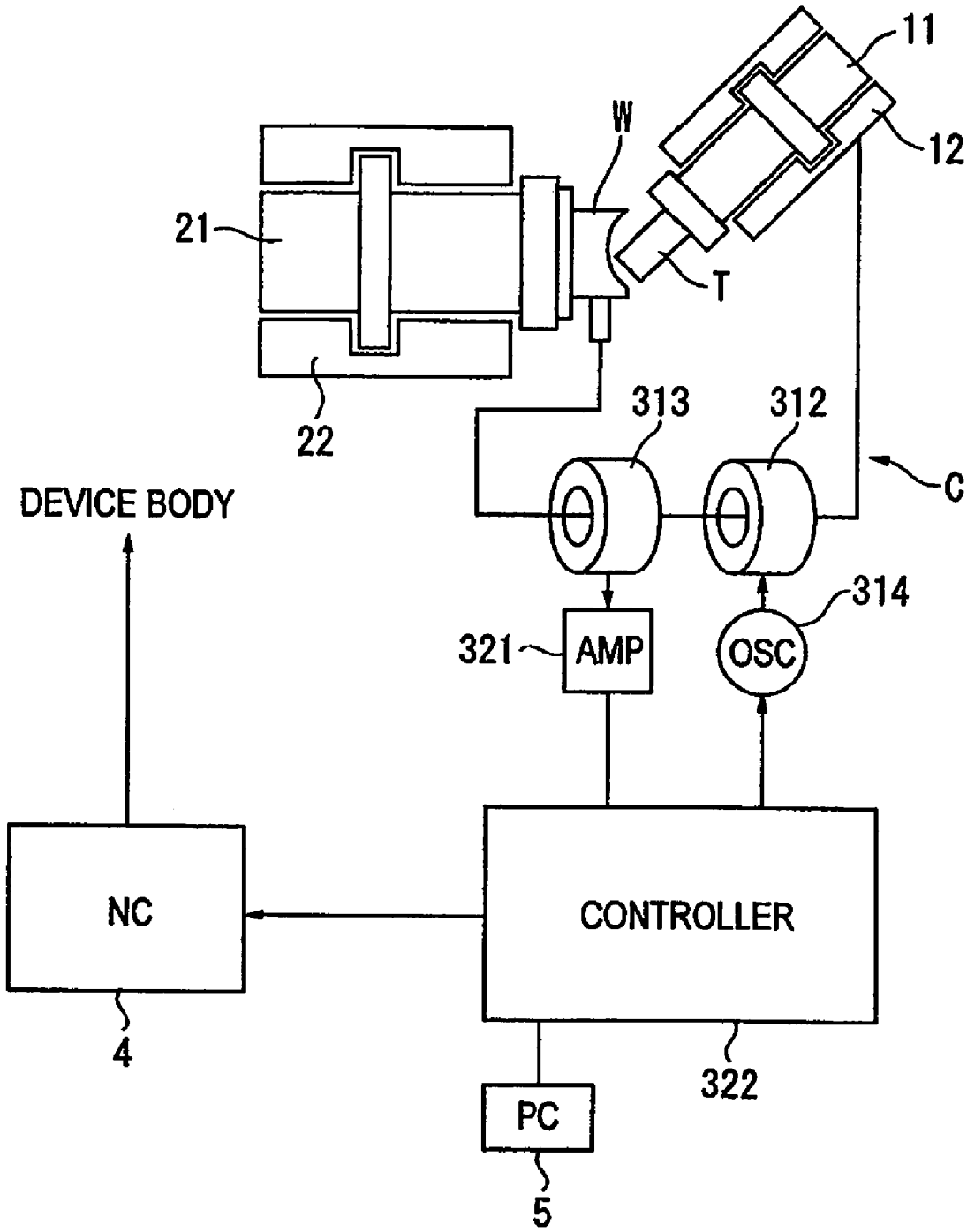
FIG. 6 is an illustration showing a machining device according to a fifth embodiment of the present invention.

As shown in FIG. 6, in a machining device according to the present embodiment, a personal computer (PC) 5 is provided instead of the digital oscilloscope 323 and the LCD monitor 3227 of the first embodiment.

The personal computer 5 exchanges data with the controller 322. On the display screen (display), not only the amplified signal from the amplifier unit 321 in waveform with the amplified signal being converted into analog from digital by the A/D converter 3221, but also the various pieces of numeric value information and the various conditions are displayed. Here, the display screen of the personal computer 5 may be a storage display.

Sixth Embodiment

Next, a sixth embodiment of the present invention will be described.

Figure 7:
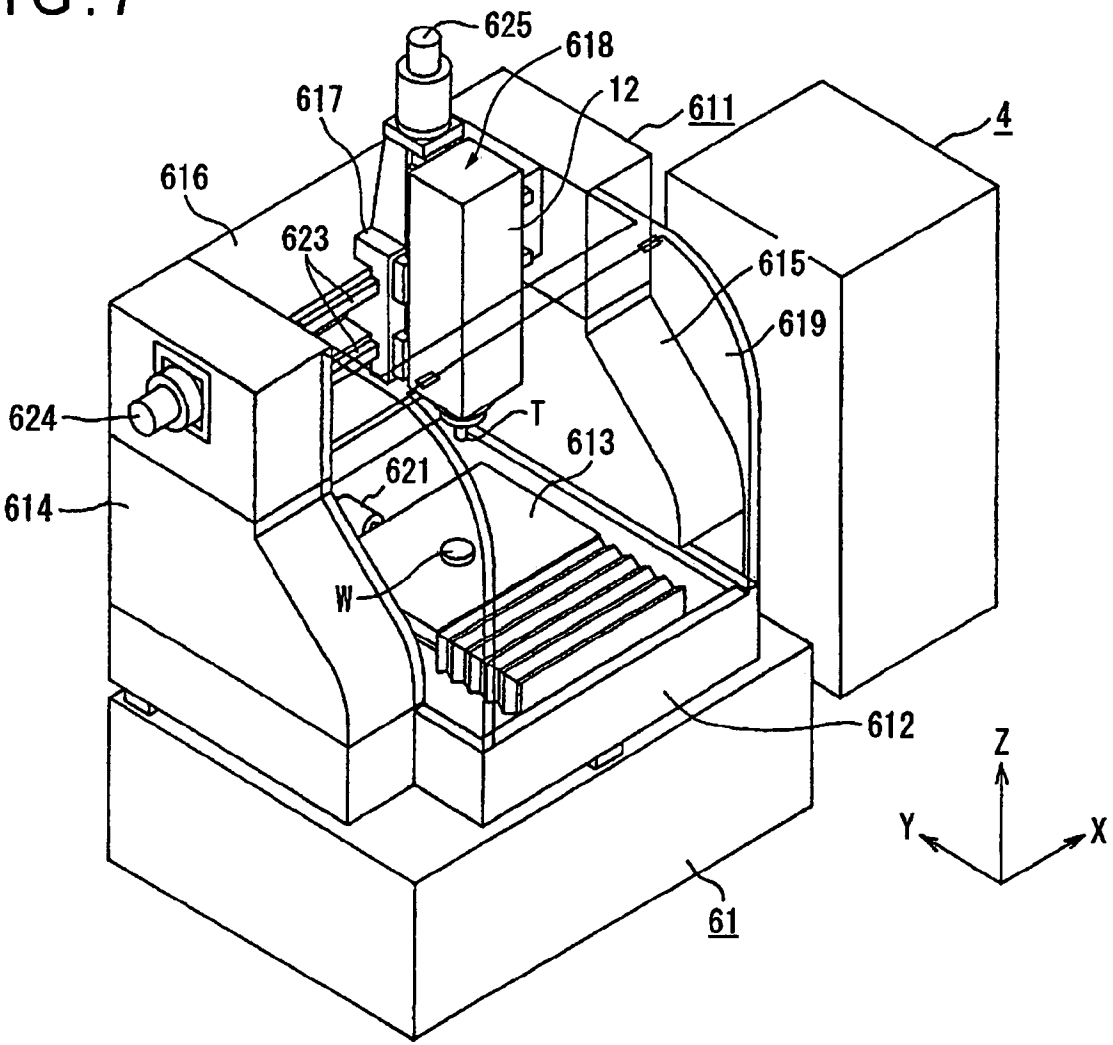
FIG. 7 is an illustration showing an NC processing machine according to a sixth embodiment of the present invention.

FIG. 7 is an exploded illustration showing an NC processing machine as a machining device of the present invention. As shown in the drawing, the NC processing machine according to the present embodiment is a machine tool controlled by the NC device, the NC processing machine including a base 61, a machine body 611 provided on the base 61, and the NC device 4 that controls the drive of the machine body 611.

The machine body 611 includes a bed 612 attached on the top surface of the base 61 with a lever or the like interposed therebetween, a table 613 provided on the top surface of the bed 612 movably in a back and forth direction (Y-axis direction), a pair of columns 614 and 615 vertically arranged on the both sides of the bed 612, a cross rail 616 bridged between the upper portions of the both columns 614 and 615, a slider 617 provided along the cross rail 616 movably in a horizontal direction (X-axis direction), a spindle head 618 provided on the slider 617 movably in a vertical direction (Z-axis direction), and a splashguard 619 provided to cover the front portion between the columns 614 and 615 so as to be transparent against the inside as well as to be openable/closable in a vertical direction with the upper end thereof being a supporting point.

The workpiece W is set on the table 613 as a workpiece holder of the present invention. The workpiece W and the table 613 are made of conductive material, and they are electrically connected.

Provided on the bed 612 is a Y-axis driver 621 that moves the table 613 in the Y-axis direction as well as a guide (not shown) that guides the table 613. As for the Y-axis driver 621, a lead screw mechanism is employed, the lead screw mechanism consisting of a motor and a lead screw shaft rotated by the motor.

Each of the columns 614 and 615 is formed substantially in a triangle with the lower portion being wider than the upper portion. Since the lower portion is stable, vibration is less likely generated even though the spindle head 618 provides high-speed rotation.

The cross rail 616 is provided with two guide rails 623 that movably guide the slider 617, and also an X-axis driver 624 that moves the slider 617 in the X-axis direction.

The slider 617 is provided with a guide (not shown) that guides the spindle head 618 in the Z-axis direction, and also a Z-axis driver 625 that moves the spindle head 618 in the Z-axis direction. As for these drivers 624 and 625, a lead screw mechanism is employed, the lead screw mechanism consisting of a motor and a lead screw shaft rotated by the motor as similar to the Y-axis driver 621.

The spindle head 618 has the main spindle 11 (not shown in FIG. 7) and the main spindle housing 12 formed as covering the outer peripheral surface of the main spindle 11, the tool T being detachably attached to the tip end of the main spindle 11.

Since the air bearing is formed between the main spindle 11 and the main spindle housing 12, the both are in non-contact state, electrically defining the capacitor (Ct). Additionally, the main spindle housing 12 and the table 613 are connected by the conductor 311 (not shown).

In machining of the workpiece W by the tool T, when the tool T contacts the workpiece W, the closed-circuit C (not shown) is formed, connecting the tool T, the workpiece W, the table 613, the conductor 311, the main spindle housing 12, the main spindle 11 and again the tool T in that order. The high-frequency generator 314 and the exciting coil 312 (both not shown) apply the alternating-current to the closed-circuit C. As the alternating-current is changed along with the change in the contact state (machining state) between the tool T and the workpiece W, the induction current is generated in the detector coil 313 (not shown), thus the detector coil 313 sensing the change in the contact state. The controller 322 (not shown) monitors and controls the contact state according to the induction current. When sensing the contact state as abnormal (heavy contact or non-contact), the controller 322 transmits the alarm signal to the NC device 4. The NC device 4 then automatically corrects the various numeric value data for machining control and recovers the contact state to the normal (light contact).

Note that, in machining of the workpiece W, machining is performed on the workpiece W by the rotation tool T attached to the main spindle 11 in response to the command from the NC device 4 while the table 613 and the spindle head 618 are moved relatively in the X, Y and Z-axis directions. Specifically, machining is performed on the workpiece W by the rotation tool T attached to the main spindle 11 while the table 613 is moved in the Y-axis direction by the Y-axis driver 621 and the spindle head 618 is moved in the X and Z-axis directions by the X-axis driver 624 and the Z-axis driver 625.

Incidentally, the present invention is not limited to the above-described embodiments, and modifications and improvements may be included as long as the object of the present invention can be attained.

For example, in the respective embodiments, although the main spindle air bearing 14 is provided as the first non-contact bearing of the present invention while the workpiece shaft air bearing 24 is provided as the second non-contact bearing of the present invention, however in the present invention, the first and the second non-contact bearings no need to be air bearings, and may be magnetic bearings or air/magnetic complex bearings.

Although the one end of the conductor 311 is attached to the main spindle housing 12 and the other end thereof is attached to the workpiece W via the brush 315 to define the closed-circuit C in the first embodiment, the one end of the conductor 311 may be attached to the tool T via a conductive brush and the other end thereof may be attached to the conductive workpiece shaft housing 22 to define the closed-circuit C in the present invention. At this time, the insulation 25 in FIG. 1 needs to be eliminated, and the workpiece W is electrically connected to the workpiece shaft 21 directly. Also, the workpiece shaft 21 and the workpiece shaft housing 22 need to be conductive. Here, the closed-circuit C is formed for connecting the tool T, the workpiece W, the workpiece shaft 21, the workpiece shaft housing 22, the conductor 311, the brush and again the tool T in that order. Incidentally, there is capacitive coupling between the workpiece shaft 21 and the workpiece shaft housing 22 by the capacitor Cw. In such closed-circuit C, since there is no need to apply the alternating-current to the main spindle 11 and the main spindle housing 12, the tool T and the main spindle 11 are preferably be insulated from each other by interposing an insulation therebetween.

Although the alternating-current applied to the closed-circuit C is detected by detecting the induction current generated in the detector coil 313 in the first embodiment, the alternating-current passing through the closed-circuit C may be detected directly in the present invention. Otherwise, a resistor may be connected to the closed-circuit C in series to detect the alternating-current by detecting the voltage applied to the resistor.

Although the high-frequency generator 314 and the exciting coil 312 apply the alternating-current to the closed-circuit C in the first embodiment, an AC power supplier may be connected to the closed-circuit C in series to apply the alternating-current directly in the present invention. In this case, the alternating-current generated by the AC power supplier is preferably the constant frequency.

EXAMPLES

Next, examples of the present invention will be described.

First Example

Figure 8:
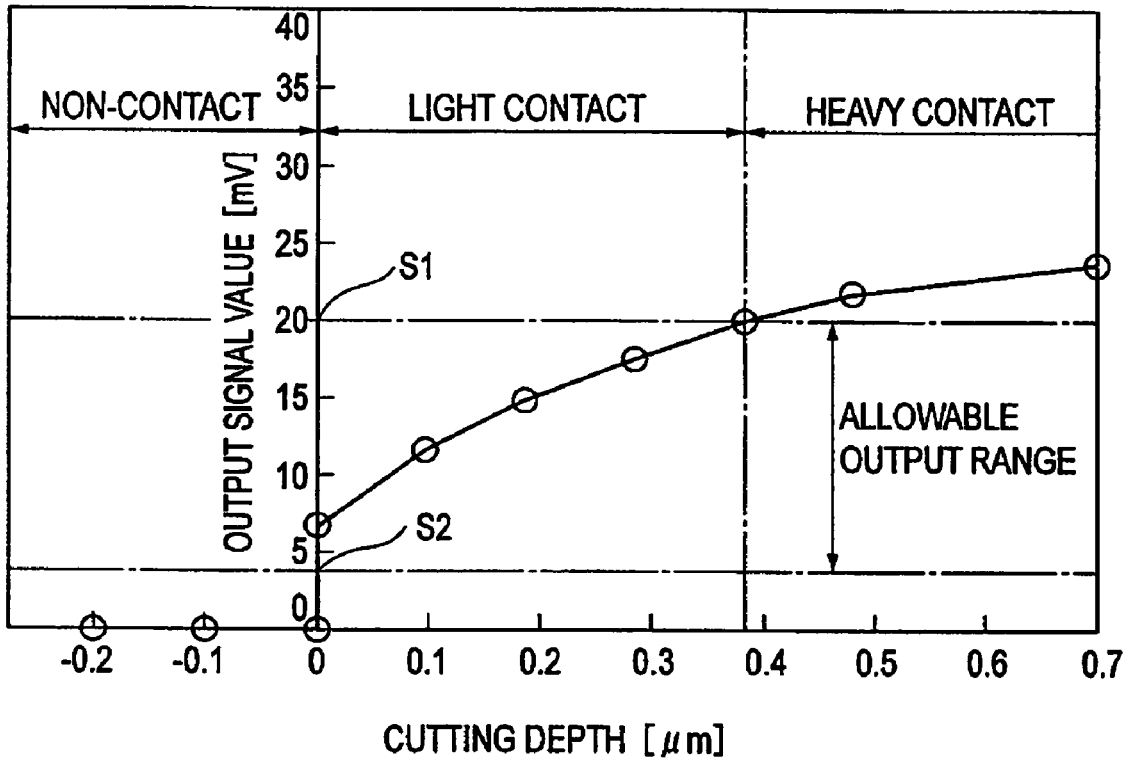
FIG. 8 is a graph showing a relationship between a cutting depth of a tool against a workpiece and an output signal value according to a first example of the present invention.

FIG. 8 is the change in value of an output signal (vertical axis) when the cutting depth (horizontal axis) of the workpiece W against the tool T is changed in the machining device as shown in FIG. 1. Note that the output signal is an amplified signal from the amplifier unit 321, the amplified signal being processed with analog-to-digital conversion by the A/D converter 3221.

In FIG. 8, since a region where the cutting depth is shown as minus value represents the non-contact state (see FIG. 2A) between the tool T and the workpiece W, the closed-circuit C is not formed, thereby the output signal indicating 0 mV. From this state, since the tool T and the workpiece W come closer and contact with each other (at the cutting depth=0 μm), the closed-circuit C is formed and then the output signal of 6 to 7 mV is immediately generated. Owing to this, by monitoring the value of the output signal, the moment of contacting between the tool T and the workpiece W can precisely be given. In this state, if the non/light contact-determining threshold S2 is set approximately at 3 mV for instance, the contact state can appropriately be determined whether the non-contact state or the light contact state (see FIG. 2B) by the threshold S2.

As the cutting depth is gradually increased from 0 μm, the value of the output signal is also increased, and consequently, there is positive correlation between the cutting depth and the output signal value. Therefore, by utilizing the output signal value, the change from the light contact state to the heavy contact state (see FIGS. 2C and 2D) along with the increase in the cutting depth can be monitored. As mentioned before, although the boundary between the light contact state and the heavy contact state is not definitely clear, when assuming that the boundary exists at the output signal value of 20 mV, the contact state can be determined whether the light contact state or the heavy contact state by the light/heavy contact-determining threshold S1 since that output signal value is set as the threshold S1.

In machining, since the output value is controlled so that the value exists in a region (allowable output range) defined between the threshold S1 (=20 mV) and the threshold S2 (=3 mV), the contact state between the tool T and the workpiece W can constantly be maintained to be the light contact state.

Second Example

Explanation referring to FIG. 9 will be given.

Each datum in the scatter graph plots the output signal value in machining and the surface roughness (PV value: unit μm) of the machining surface after machining in a case where machining is conducted without setting the light/heavy contact-determining threshold S1 of the respective embodiments. Note that, the surface roughness of the machining surface is measured by a coordinate measuring machine.

As easily figured out from the plot, there is positive correlation between the output signal value and the surface roughness after machining. Therefore, it is obvious that the output signal value can function as an indicator of the surface roughness. Owing to this, when the allowable range of the output signal value is defined by setting the light/heavy contact-determining threshold S1, the surface roughness (PV value) can be restrained within the desired range, thereby maintaining the manufacturing accuracy constantly and highly accurately.

Figure 9:
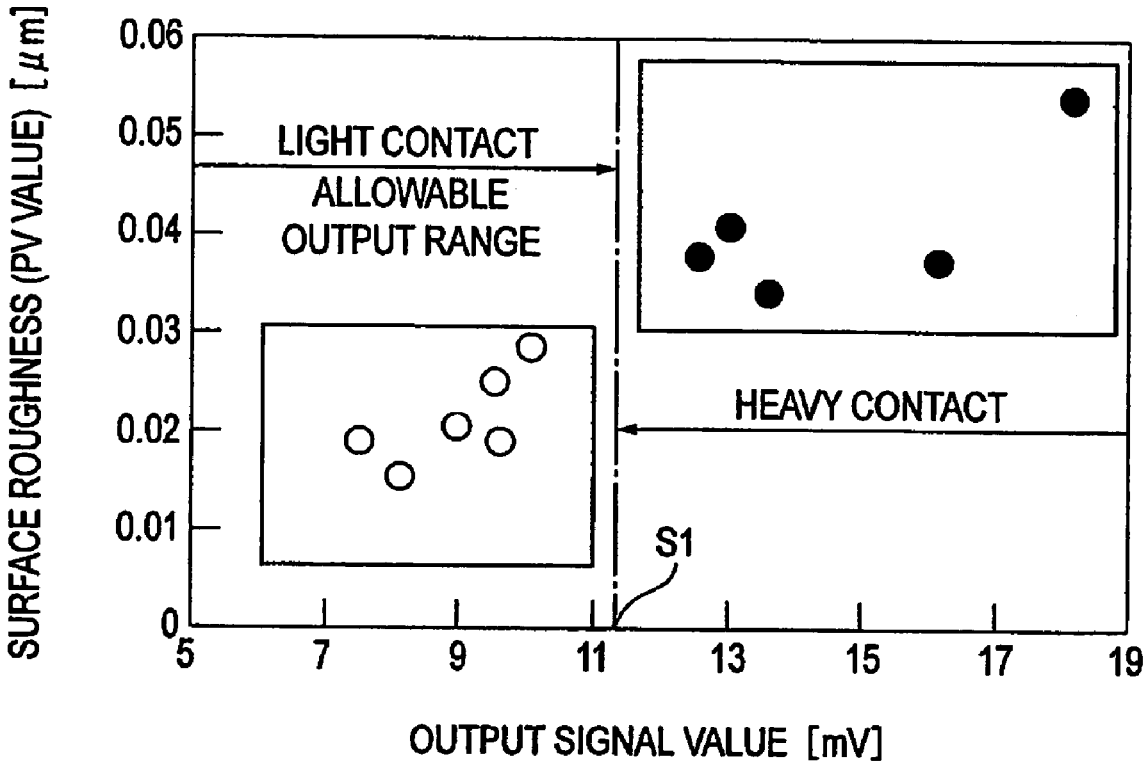
FIG. 9 is a scatter graph showing a relationship between an output signal value during machining and a surface roughness of a machining surface after machining according to a second example.
Figure 10:
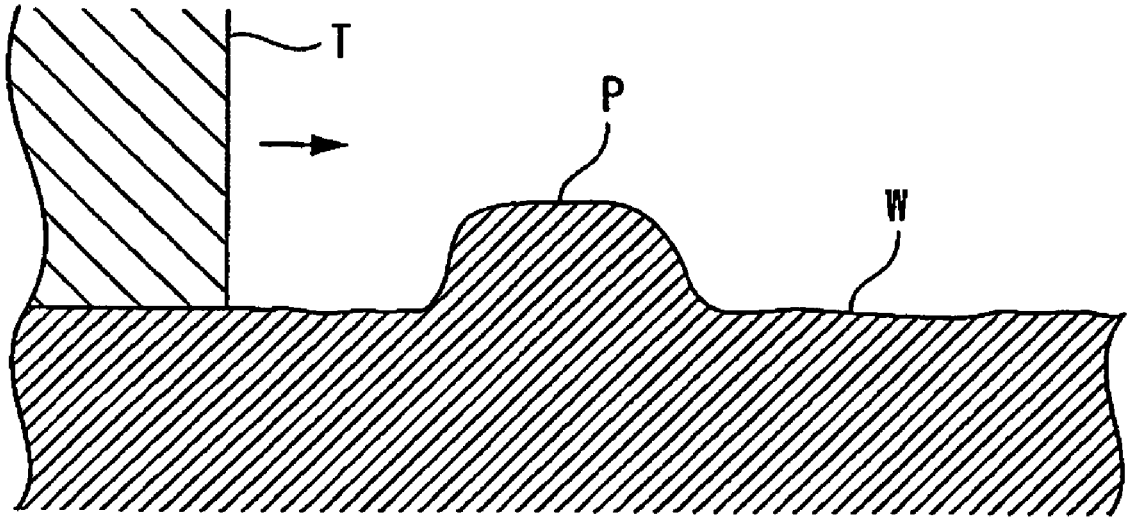
FIG. 10 PRIOR ART
FIG. 10 is an explanatory diagram of a disadvantage of a related art likely caused by cutting a workpiece surface with a projecting portion using a tool.

Here is, for instance, a method using the data in FIG. 9 for setting the light/heavy contact-determining threshold S1 in a case where machining needs the manufacturing accuracy with the PV value equal to or less than 0.03 μm. In FIG. 9, valid data of which PV value are equal to or less than 0.03 μm are represented as open circles (○) while invalid data of which PV value are equal to or more than 0.03 μm are represented as closed circles (•). Regarding these data as the output signal values, since the boundary between these open circles (○) and the closed circles (•) exist around the value of 11 mV, the light/heavy contact-determining threshold S1 is set at this location. Then, the output signal value is constantly maintained equal to or less than S1 in machining, so that the surface roughness (PV value) after machining can also be restrained within the desired range (PV value is equal to or less than 0.03 μm).

While it is obvious from the method for setting the light/heavy contact-determining threshold S1, the present example defines the contact state between the tool T and the workpiece W with the PV value after machining being equal to or less than 0.03 μm as the light contact state, and defines the contact state with the PV value being equal to or more than 0.03 μm as the heavy contact state. This is merely one of the definitions for the light contact state and the heavy contact state, however, the light/heavy contact-determining threshold S1 defined in the above-described manner and then set is in fact the optimum threshold for preventing the manufacturing accuracy from deteriorating.

The priority application Number JP2004-212132 upon which this patent application is based is hereby incorporated by reference.

What is claimed is:

1. A machining device, comprising:

a rotatable conductive workpiece holder that holds a conductive workpiece;

a rotatable conductive tool holder that holds a conductive tool for machining the workpiece;

a first conductive outer peripheral portion formed to cover at least a part of an outer peripheral surface of the tool holder;

a second conductive outer peripheral portion formed to cover at least a part of an outer peripheral surface of the workpiece holder;

a first non-contact bearing formed by elevating the tool holder from an inner peripheral surface of the first outer peripheral portion;

a second non-contact bearing formed by elevating the workpiece holder from an inner peripheral surface of the second outer peripheral portion;

a conductor that electrically connects the first outer peripheral portion with the workpiece and the first outer peripheral portion with the second outer peripheral portion;

a closed-circuit formed when the workpiece contacts the tool in machining, the closed-circuit connecting in order the workpiece, the tool, the tool holder, the first outer peripheral portion, the conductor, the second outer peripheral portion and the workpiece holder;

an AC power supplier that feeds an alternating-current to the closed-circuit; p1 a detector that detects the alternating-current passing through the closed-circuit; and a monitoring/controlling unit that monitors an output value of a signal based on the alternating-current detected by the detector according to a predetermined monitoring condition, wherein the monitoring condition includes a light/heavy contact-determining threshold for determining whether a contact state between the workpiece and the tool is a light contact or a heavy contact, and wherein the monitoring/controlling unit controls the contact state between the workpiece and the tool so that the output value of the signal constantly stays within a light contact region relative to the light/heavy contact-determining threshold.

2. The machining device according to claim 1, wherein the monitoring/controlling unit further includes:

an alerter unit that alerts a user when the output value of the signal exceeds the light/heavy contact-determining threshold and becomes a value within a heavy contact region.

3. The machining device according to claim 1, wherein the monitoring/controlling unit further includes:

a storage unit that stores the monitoring condition; and an input unit that inputs a desired monitoring condition to be stored in the storage unit.

4. The machining device according to claim 1, wherein the monitoring/controlling unit further includes:

a display unit that displays information relating to the contact state between the workpiece and the tool.

5. The machining device according to claim 1, wherein the detector includes a detector circuit interlinked with a magnetic flux generated from the closed-circuit, and the monitoring/controlling unit monitors the output value of the signal based on an induction current generated from the detector circuit according to the monitoring condition.

6. The machining device according to claim 1, wherein the AC power supplier includes an AC power generator that generates the alternating-current at a constant frequency, and an exciting circuit to which the alternating-current is fed, and the closed-circuit is interlinked with a magnetic flux generated from an exciting coil.

7. A machining device, comprising:

a rotatable conductive workpiece holder that holds a conductive workpiece;

a tool holder that holds a conductive tool for machining the workpiece;

a conductive outer peripheral portion formed to cover at least a part of an outer peripheral surface of the workpiece holder;

a non-contact bearing formed by elevating the workpiece holder from an inner peripheral surface of the outer peripheral portion;

a conductor that electrically connects the outer peripheral portion with the tool;

a closed-circuit formed when the workpiece contacts the tool in machining, the closed-circuit connecting in order the tool, the workpiece, the workpiece holder, the outer peripheral portion and the conductor;

an AC power supplier that feeds an alternating-current to the closed-circuit;

a detector that detects the alternating-current passing through the closed-circuit; and a monitoring/controlling unit that monitors an output value of a signal based on the alternating-current detected by the detector according to a monitoring condition, wherein the monitoring condition includes a light/heavy contact-determining threshold for determining whether a contact state between the workpiece and the tool is a light contact or a heavy contact, and wherein the monitoring/controlling unit controls the contact state between the workpiece and the tool so that the output value of the signal constantly stays within a light contact region relative to the light/heavy contact-determining threshold.

8. The machining device according to claim 7, wherein the monitoring/controlling unit further includes:

an alerter unit that alerts a user when the output value of the signal exceeds the light/heavy contact-determining threshold and becomes a value within a heavy contact region.

9. The machining device according to claim 7, wherein the monitoring/controlling unit further includes:

a storage unit that stores the monitoring condition; and an input unit that inputs a desired monitoring condition to be stored in the storage unit.

10. The machining device according to claim 7, wherein the monitoring/controlling unit further includes:

a display unit that displays information relating to the contact state between the workpiece and the tool.

11. The machining device according to claim 7, wherein the detector includes a detector circuit interlinked with a magnetic flux generated from the closed-circuit, and the monitoring/controlling unit monitors the output value of the signal based on an induction current generated from the detector circuit according to the monitoring condition.

12. The machining device according to claim 7, wherein the AC power supplier includes an AC power generator that generates the alternating-current at a constant frequency, and an exciting circuit to which the alternating-current is fed, and the closed-circuit is interlinked with a magnetic flux generated from an exciting coil.

* * * * *

UNITED STATES PATENT AND TRADEMARK OFFICE

CERTIFICATE OF CORRECTION

PATENT NO. : 7,104,866 B2
APPLICATION NO. : 11/179641
DATED : September 12, 2006
INVENTOR(S) : Yasuo Yamane et al.

It is certified that error appears in the above-identified patent and that said Letters Patent is hereby corrected as shown below:

Title Page, Item (57), line 6, "(T" should read --(T)--.

Column 18, line 34, delete "p1".

Signed and Sealed this

Second Day of October, 2007

JON W. DUDAS
*Director of the United States Patent and Trademark Office*